US007222986B2

(12) United States Patent
Mah

(10) Patent No.: US 7,222,986 B2
(45) Date of Patent: May 29, 2007

(54) MULTIPLE SWIVEL FLASHLIGHT

(75) Inventor: Pat Y. Mah, Kowloon (HK)

(73) Assignee: Daka Research Inc., Tortolla (VG)

( * ) Notice: Subject to any disclaimer, the term of this patent is extended or adjusted under 35 U.S.C. 154(b) by 91 days.

(21) Appl. No.: 11/075,076

(22) Filed: Mar. 7, 2005

(65) Prior Publication Data

US 2006/0198133 A1 Sep. 7, 2006

(51) Int. Cl.
*F21L 4/02* (2006.01)

(52) U.S. Cl. ..... 362/202; 362/250; 362/418; 362/427; 362/188; 362/184; 362/199

(58) Field of Classification Search ..... 362/202, 362/297, 187, 190, 197, 239, 241, 282, 371, 362/418, 427, 429, 449, 420, 188, 184, 199, 362/250

See application file for complete search history.

(56) References Cited

U.S. PATENT DOCUMENTS 2,861,174 A 10/1953 Talbot
3,030,497 A 4/1962 Cheng
5,169,226 A * 12/1992 Friedman ..... 362/190
5,971,562 A 10/1999 Yang
6,190,023 B1 * 2/2001 Leadford et al. ..... 362/303

FOREIGN PATENT DOCUMENTS

EP 0206702 12/1986

* cited by examiner

*Primary Examiner*—Sandra O'Shea
*Assistant Examiner*—Sharon Payne
(74) *Attorney, Agent, or Firm*—Curtis L. Harrington; Kathy E. Harrington; Harrington & Harrington

(57) ABSTRACT

A multiple swivel flashlight provides a stable housing with flat bottom for ready support on most surfaces, as well as a pair of lamp reflector arms which are either conducting or carry conductors to supply the reflectors with the voltage and current needed to drive the lamps. Where the exterior of the support arms are conducting, they are either coated or painted to insulate the exterior. Where the support arms are non-conducting, conductors are either inlaid or attached, preferably along the interior surface of the conductors. The support arms support the reflectors at an angle in order to enable the user to optimally adjust the position of the multiple swivel flashlight.

6 Claims, 2 Drawing Sheets

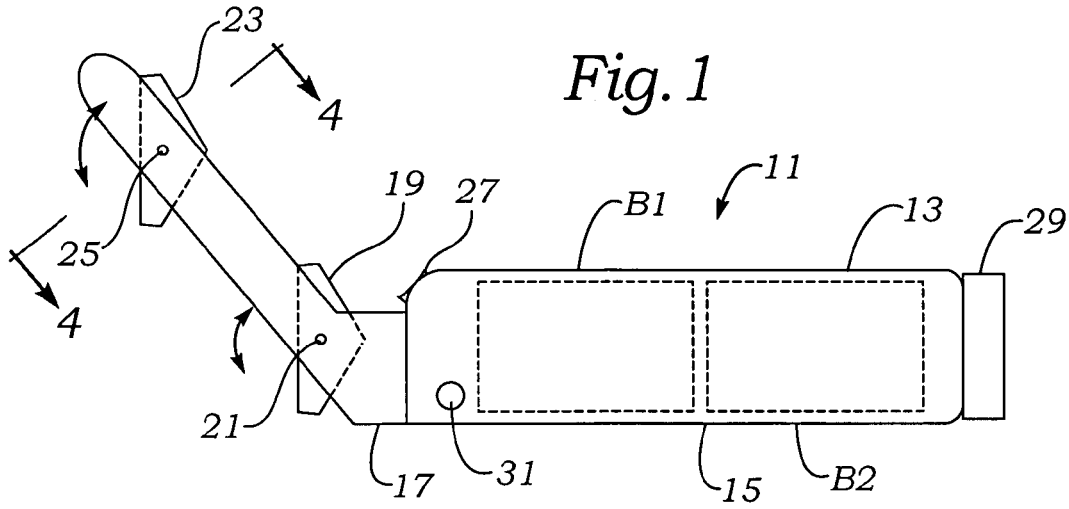
Fig. 1
Fig.2
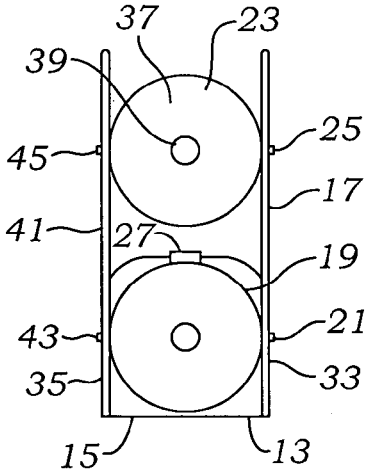
Fig.3
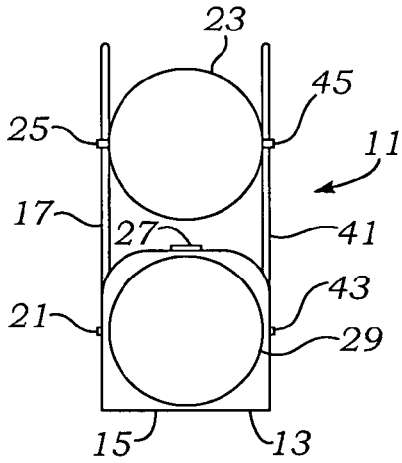
Fig.5
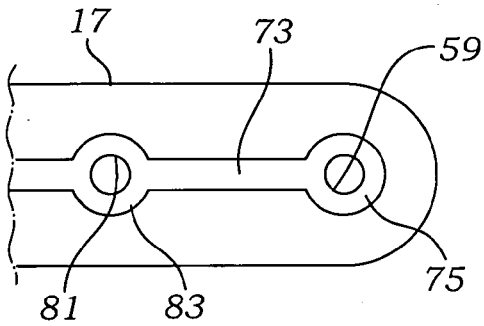
Fig.4
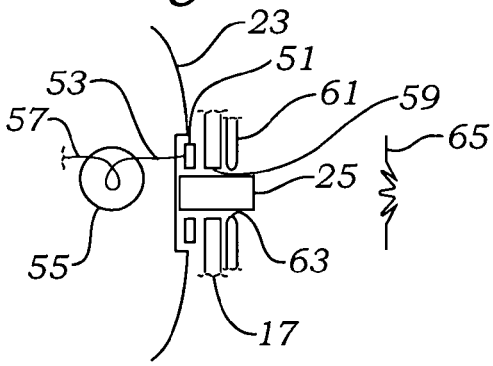

MULTIPLE SWIVEL FLASHLIGHT

FIELD OF THE INVENTION

The present invention relates to lighting equipment and more particularly to flashlight having double swiveling illumination elements which can be independently angularly adjusted. The angular relationship of the illumination elements enables the user to either carry or set the flashlight down for advantageous usage.

BACKGROUND OF THE INVENTION

A number of systems have been available for illumination. The constant which has heretofore been present in portable illumination is the design conflict between a carried or portable lighting unit and a stable or independently supported unit. As a prime example, utility lights have a large six-volt lantern size battery and are handy and balanced for carrying, but awkward for setting up for use in a free-standing application. Cylindrical in line battery type hand held flashlights have the same problem, they are difficult to temporarily set up in a free-standing position.

Further, either the lantern or single in line conventional flashlight have the limitation of a single lamp and reflector. Where a wider area is sought to be illuminated, the user has to wave the light back and forth. Where two areas of interest are fairly close together a slight waving motion is required. Where two widely separated areas of interest exist, more rapid and extreme movement is needed to keep both sides visible.

In the alternative, there are commercial light sets which range from trailer mounted light trees complete with generators. However these systems are not portable nor carryable into tight working spaces where both the ability to aim and direct the light may be compromised, as well as the ability to apply more than one source of light.

Failure mode is another area where conventional portable lighting typically fails. In a close dark work space, the failure of the main bulb element can leave a worker totally in the dark, unless he carries a backup light source. Even when a backup source is carried, it may be difficult to locate where the worker is plunged into darkness unexpectedly.

SUMMARY OF THE INVENTION

A multiple swivel flashlight provides a stable housing with flat bottom for ready support on most surfaces, as well as a pair of lamp reflector arms which are either conducting or carry conductors to supply the reflectors with the voltage and current needed to drive the lamps. Where the exterior of the support arms are conducting, they are either coated or painted to insulate the exterior. Where the support arms are non-conducting, conductors are either inlaid or attached, preferably along the interior surface of the conductors.

The support arms support the reflectors at an angle in order to enable the user to optimally adjust the position of the multiple swivel flashlight, so that the reflectors can be positioned to not interfere with each other. With the light reflectors positioned to pivot from lines placed at an angle to the base, the base may be carried in the same manner as a conventional flashlight with both light beams being directed forward, with the beams either focussed at an area or divergingly spread apart. In the alternative, the top reflector can be directed upwardly to provide light reflected from a ceiling while the bottom reflector can be directed forward to enable directed placement of the beam. In the alternative, and particularly when no ceiling is present, the bottom reflector can be directed downwardly to illuminate the path for better walking while the top reflector is directed forward to illuminate areas much farther forward of the user.

In a non-carried situation, the multiple swivel flashlight can be placed on a surface and have its reflectors oriented at the areas of interest, particularly work spaces. The multiple swivel flashlight can be supported from its flat bottom or stood upright upon its battery compartment cap. Further, although predominantly shown as having relative dimensions based around a battery compartment as a multi celled "D" sized tube, it is understood that the flashlight may have any number and type of batteries, including lantern and cylindrical dry cell batteries. If one bulb burns out, the user can either carry on with one light source, or change the bulb using the light from the reflector still outputting light.

A telescoping embodiment is disclosed which shows three reflectors and enables both pivoting and height and reflector spacing by the provision of a telescoping version of the reflector supports. The current supplied to the reflectors is provided through insulated telescoping supports which have a system of internal conductance surfaces with current transferred by a wiping structure regardless of the height of deployment of the telescoping structure. A swich may be provided for selective energization of one or more of the reflectors independently in order to conserve battery power and to provide for maximum user selectability.

BRIEF DESCRIPTION OF THE DRAWINGS

The invention, its configuration, construction, and operation will be best further described in the following detailed description, taken in conjunction with the accompanying drawings in which:

FIG. 1 is a side view of the multiple swivel flashlight and illustrating the angled support from which the pivoting reflectors depend;

FIG. 2 is a front view of the multiple swivel flashlight illustrating the relative displacement of the reflectors and vertical profile;

FIG. 3 is a rear view and illustrating the circular battery containment cap;

FIG. 4 is a closeup view taken along line 4-4 of FIG. 1 and illustrating the mechanics of pivoting contact between a fully conductive conducting reflector support arm supporting a pivotable reflector;

FIG. 5 is an inside view of a second embodiment of a conducting reflector support arm made of insulating material having an inlay or line of deposition of conducting material and forming annular areas around apertures through which pivot axis fittings of the pivotable reflectors extend;

DETAILED DESCRIPTION OF THE PREFERRED EMBODIMENT

Figure 6:
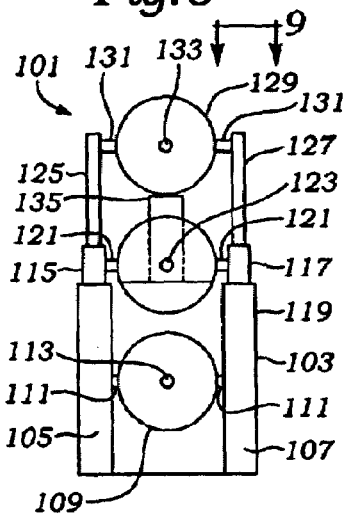
FIG. 6 is a front view of a vertically expandable lantern-style flashlight with a pivotable base reflector and a pair of upper displaceable and pivoting reflectors.

A multiple swivel flashlight 11 includes a main housing 13, preferably having a flat base 15 for improved stability when placed on a nearly horizontal surface. The multiple swivel flashlight 11 is shown is a two reflector embodiment. From the side view of FIG. 1, a first conducting reflector support arm 17 can be seen as supporting a first axially pivotable reflector 19 at a pivot point seen as a first reflector first pivot axis fitting 21. First conducting reflector support arm 17 can also be seen as supporting a second axially pivotable reflector 23 at its pivot point seen as a second reflector first pivot axis fitting 25.

A positive electrical and mechanical engagement rocker switch 27 can be partially seen as placed in a position on the main housing 13 to enable thumb manipulation but with a positive on and off operation as is advantageous for both carried and placed utilization of the multiple swivel flashlight 11. At the end of multiple swivel flashlight 11 a battery end cap 29 is seen. The battery end cap is preferably also flat at its rearward face in order to enable the multiple swivel flashlight 11 to be placed on its end. This position will give the first and second axially pivotable reflectors 19 and 23 a higher vantage point.

Where the first and second axially pivotable reflectors 19 and 23 are able to draw power from a pair of conducting reflector support arms, their swivel may continue for 360° about their pivot axis without having to worry about connecting wires limiting the degree of pivot. Further, and given the angular relationship, where connecting wires between the main housing 13 and the first and second axially pivotable reflectors 19 and 23 are used and where the degree of pivot may be restricted, the combination of the angular relationship of the supports, relative displacement of the first and second axially pivotable reflectors 19 and 23 will still enable nearly any placement of the beams by a directed orientation of the first and second axially pivotable reflectors 19 and 23, along with the positioning of the housing 13. However, where wires are eliminated, the first and second axially pivotable reflectors 19 and 23 may be more readily adjusted without concern for undue wear and pulling on the wires.

The orientation of the multiple swivel flashlight 11 seen in FIG. 1 is lying on one side of its housing 13 with the flat surface 15 in the down position. Inside the housing 13 and shown in dashed line format are batteries B1 and B2 which are depicted as a pair of cylindrical batteries, although other battery types and configurations are possible. Also seen is a charging/auxiliary port 31 for accepting an external source of power, such as alternating or direct current from a wall charger or other charger. With this added power input possibility the multiple swivel flashlight 11 can be operated with batteries, with auxiliary power with batteries, and with auxiliary power without batteries. When multiple swivel flashlight 11 is used with both batteries and auxiliary power it will serve as an un-interruptible light source, a particularly valuable orientation where power is not constant. An optional control can either enable user selectability or automatic sensing of whether rechargeable or alkaline batteries B1 & B2 are used so that auxiliary power operation can be had by switched control or constant re-charging. One or more of the multiple swivel flashlights 11 can be set up in a work space and left on indefinitely as the sole power sources with no fear of temporary power interruption.

Referring to FIG. 2, a front view better illustrates the relationship of the first and second axially pivotable reflectors 19 and 23 with respect to each other. The relationship angle and separation enables the first and second axially pivotable reflectors 19 and 23 to achieve a large angular span of coverage without interference with each other. Should the angles of coverage start to interfere, the multiple swivel flashlight 11 can simply be reversed (especially if its standing on its end, cap 29) with the first and second axially pivotable reflectors 19 and 23 re-adjusted for a wider, cooperative relationship.

FIG. 2 also illustrates details of the first and second axially pivotable reflectors 19 and 23, including first reflector surface 33 and first bulb 35 of first axially pivotable reflector 19 and a second reflector surface 37 and second bulb 39 of second axially pivotable reflector 23. A second conducting reflector support arm 41 is seen opposite the first conducting reflector support arm 17.

Also seen is the first reflector second pivot axis fitting 43 and the second reflector second pivot axis fitting 45. The rocker switch 27 is also partially seen. Both of the first and second conducting reflector support arms 17 and 41 can be made long enough to allow the multiple swivel flashlight 11 to be turned over and rest upon them and facilitate a wide range of angles. For example, referring to FIG. 1, if it was desired to illuminate in a direction to the upper left of FIG. 1, along the length of the first and second conducting reflector support arms 17 and 41, the user can either turn the housing 13 around and direct the first and second axially pivotable reflectors 19 and 23 rearward, over the housing 13, or the multiple swivel flashlight 11 can be turned over to rest on the first and second conducting reflector support arms 17 and 41 for a quick re-adjustment of the first and second axially pivotable reflectors 19 and 23.

Referring to FIG. 3, a rear view illustrates a predominant view of the battery end cap 29. The curved edges of the top of the main housing 13 facilitates manual carriage and handling.

Referring to FIG. 4, one possible configuration for the electrical connection of the first and second axially pivotable reflectors 19 and 23 with respect to the first and second conducting reflector support arms 17 and 41 is shown. In the embodiment seen in FIG. 4, the first and second conducting reflector support arms 17 and 41 are pre stressed to provide a bias toward each other to apply a sandwiching pressure to the first and second axially pivotable reflectors 19 and 23 with respect to the first and second conducting reflector support arms 17 and 41.

The view of FIG. 4 is taken along line 4-4 of FIG. 1 and contemplates that the first and second conducting reflector support arms 17 and 41 are themselves conductive and covered by an insulating material at least on the outside and free of insulation material at the point of electrical contact. In FIG. 4, the pivot axis fitting 25 is formed integrally with the second axially pivotable reflector 23. At the base of the pivot axis fitting 25 a conductive ring 51 surrounds the pivot axis fitting 25 and is connected by a conductive wire 53 to a bulb 55, with a second conductive wire 57 leading to a similar arrangement on the other side of the second axially pivotable reflector 23 at pivot axis fitting 45.

The conductive ring 51 may be a crinkle shaped washer and will preferably be fixed with respect to the second axially pivotable reflector 23, and is located adjacent an aperture 59 in the first conducting reflector support arm 17 to accommodate the passage through of the pivot axis fitting 25. As the second axially pivotable reflector 23 turns it rubs directly against the second conducting reflector support arm 17 shown. As is seen, the second conductive arm 17 may have an insulating layer 61 which has an aperture 63 to accommodate the pivot axis fitting 25.

An optional slip nut 65 is seen which can further provide an urging axial force of the first conducting reflector support arm 17 toward the second axially pivotable reflector 23, to insure that the conductive ring 51 makes good contact with the first conducting reflector support arm 17. The location of the bulb 55 is schematic in nature and the other connection at wire 57 reflects an identical arrangement of the other side of the second axially pivotable reflector 23. The first axially pivotable reflector 19 has an identical arrangement. In terms of pre-stressing the first and second conducting reflector support arms 17 and 41, they should be able to be manually urged apart to load the first and second axially pivotable reflectors 19 and 23.

Where the first and second conducting reflector support arms 17 and 41 are to be wholly conductive, they should be firmly and insulatably mountable with respect to housing 13 which should be made of a non conducting material. The rocker switch 27 is connected internally to energize one of the first and second conducting reflector support arms 17 and 41 with respect to the other so that the bulbs 35 and 39 of the first and second axially pivotable reflectors 19 and 23 will be illuminated by switchably creating a voltage potential between the first and second conducting reflector support arms 17 and 41.

Referring to FIG. 5 an alternative embodiment of the first conducting reflector support arm 17 is seen as a non-conducting first conducting reflector support arm 71 with the same aperture 59 seen in FIG. 4. However, the inside surface of the first conducting reflector support arm 71 facing the viewer of FIG. 5 includes a conductive portion 73 which extends toward the aperture 59 and forms a circular area annular portion 75 surrounding aperture 59 to facilitate good electrical contact with respect to the conductive ring 51.

Also seen is an aperture 81 for accommodating pivot axis fitting 21 and also having a circular area annular portion 75 for electrically engaging a conductive ring 51 on first axially pivotable reflector 19. In this configuration circular area annular portions 75 and 83 provide sufficient area for electrical contact. All of the electrical structures seen in FIG. 5, including conductive portion 73, circular area annular portions 75 and 83 can be provided by an insertion into an inlay cavity of the first conducting reflector support arm 71. Other methods of conductive deposition can include vacuum vapor deposition, adhesive attachment of conductors and vapor buildup. It is recommended that enough conductor be provided in the circular area annular portions 75 and 83 to withstand long wear against the conductive rings 51 on each side of each of the first and second axially pivotable reflectors 19 and 23.

Referring to FIG. 6, a further embodiment of a multiple swivel flashlight is seen as a vertically telescoping lantern-style flashlight 101. Vertically telescoping lantern-style flashlight 101 is shown expanding vertically, but can have its supports angled forward or rearward as designed. Flashlight 101 has a main housing 103. Main housing 103 has a pair of forward projections including a right projection 105 and a left projection 107, between which a lower pivoting reflector 109 is pivotally mounted to pivot about a horizontal axis. The lower pivoting reflector 109 is supported by a pair of pivot supports 111, each of which enables current to be supplied to a bulb 113 at the center of the lower pivoting reflector 109.

Since lower pivoting reflector 109 is the lowest and supported by the main housing 103 it is the best protected and regardless of any vertical deployment of other structures, and has the horizontally narrowest supports 111. Above each of the right and left projections 105 and 107 are first telescoping sections 115 and 117, respectively. A second pivoting reflector 119 is pivotally mounted to pivot about a horizontal axis. The second pivoting reflector 119 is supported by a pair of pivot supports 121, each of which enables current to be supplied to a bulb 123 at the center of the lower pivoting reflector 119. Because the right and left projections 115 and 117 are telescopingly more narrow from the right and left projections 105 and 107 from which they depend, the pivot supports 121 may be wider and of more diameter than the pivot supports 111 to provide stability and bridge the gap between the second pivoting reflector 119 and the right and left projections 115 and 117. In the alternative, the second pivoting reflector 119 may be of a larger diameter to better occupy the space between the right and left projections 115 and 117, with the pivot supports 121 being the same as pivot supports 111.

Above each of the right and left projections 115 and 117 are second telescoping sections 125 and 127, respectively. A third pivoting reflector 129 is pivotally mounted to pivot about a horizontal axis. The third pivoting reflector 129 is supported by a pair of pivot supports 131, each of which enables current to be supplied to a bulb 133 at the center of the lower pivoting reflector 119. Again, because the right and left projections 125 and 127 are telescopingly more narrow from the right and left projections 115 and 117 from which they depend, the pivot supports 131 may be wider and of more diameter than the pivot supports 121 to provide stability and bridge the gap between the third pivoting reflector 129 and the right and left projections 125 and 127. As before, the third pivoting reflector 129 may be of a larger diameter to better occupy the space between the right and left projections 125 and 127, with the pivot supports 131, and 121 being the same as pivot supports 111. A handle 135 is seen extending partially above the second pivoting reflector 129.

Figure 7:
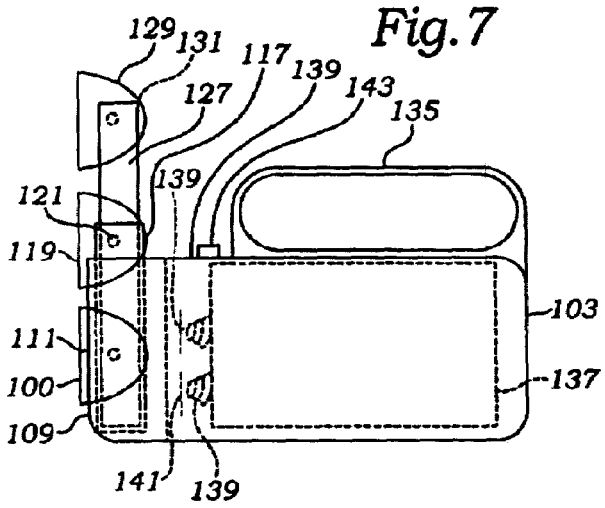
FIG. 7 is a left side view of the vertically expandable lantern-style flashlight as seen in FIG. 6 in a non expanded, compact state as was shown in FIG. 6.

Referring to FIG. 7, a left side view of the vertically telescoping lantern-style flashlight 101, seen in FIG. 6, emphasizes its handle 135 as located over a battery 137 in a lantern-style arrangement. The battery 137 may be of a type to include springs 139 to press against contacts 141 which follow other circuitry to selectively place the battery 137 into electrical contact with the bulbs 113, 123, and 133. A selector switch 143 may be provided to enable selectable energization of one or more of the bulbs 113, 123, and 133 to give maximum controllability, as well as to conserve power when only one or two or other multiples of any number of multiple reflectors need energization. Inclusion of reflectors in excess of reflectors 109, 119 and 129 is contemplated.

Figure 8:
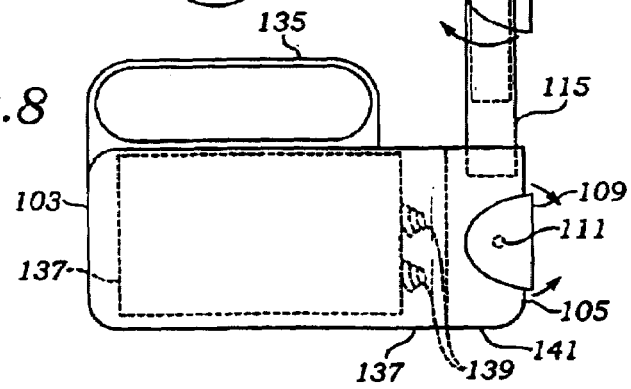
FIG. 8 is a right side view of the vertically expandable lantern-style flashlight seen in FIGS. 6 and 7, but shown in an expanded mode with telescoping supports deployed.

Referring to FIG. 8, a right side view of the vertically telescoping lantern-style flashlight 101, seen in FIGS. 6 and 7 in compact position, is now seen in expanded and deployed position. The first telescoping section 115 is seen raising the second pivoting reflector 119 higher above the main housing 103, and the second telescoping section 125 is seen raising the third pivoting reflector 129 above the second pivoting reflector 119. Arrows indicate the pivoting action of each of the reflectors 109, 119 and 129.

Figure 9:
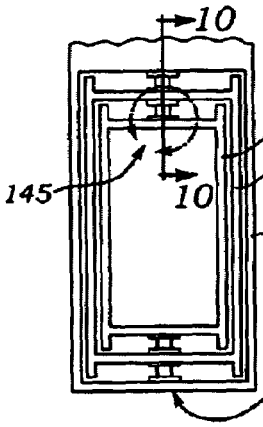
FIG. 9 is an expanded view taken along line 9-9 of FIG. 6 and illustrates one possible configuration for structures which make up the telescoping supports for the pivoting reflectors.

Referring to FIG. 9, a view looking down into the series of left projection 107, first telescoping section 117 and second telescoping section 127 is seen. In this one of many configurations, each of the first telescoping section 117 and second telescoping section 127 are seen as annular "I" beams having a central opening which either accommodates or has the ability to accommodate further telescoping sections. The use of corners having projections of the "I" shape enables a lesser wetted contact area where the "I" overall is sized to limit contact to the ends of the projections with significant clearance given with respect to adjacent large surface areas.

In addition, the use of the ends of the "I" shape as dimensioning and surface to surface contact enables the spaces defined by the dimensioning of those contact surfaces to provide a controlled electrical connection "wiping contact". At the top of FIG. 9, a wiping contact system 145 is seen. The wiping contact system 145 can be used to provide a continuous line of contact, for example, from the left projection 107 to the pivot support 131. Other sets of wiping contact system can be used to provide contact, for example, to pivot support 121.

At the bottom of FIG. 9, a wiping contact system 145 is seen as connecting a different part of the left projection 107 to the first telescoping section 117 pivot support 121. The width of the structures shown in FIG. 9 are such that multiple wiping contact systems such as wiping contact systems 145 and 147 can be placed at different heights about the inner periphery of the structures seen to provide many more than two wiping systems 145 and 147. It can easily be seen that many multiples of the telescoping reflectors 109, 119, and 121 can exist from a telescoping system.

Figure 10:
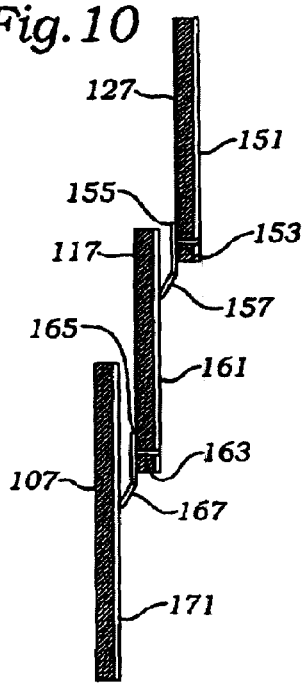
FIG. 10 is a view taken along line 10-10 of FIG. 9 and illustrating one possible conductor swiping arrangement which can be utilized within insulated telescoping supports flash compacted state.

Referring to FIG. 10, a view of the wiping contact system 145 taken along line 10-10 of FIG. 9 is illustrated. On the outside of second telescoping section 127, an insulating layer is exposed to the outside, while a conducting layer 151 is inwardly exposed. Since the view taken is on a side which does not illustrate the pivot support 131, a path (not shown) will be needed to enable the current flowing in the conducting layer 151 to reach the pivot support 131.

An electrical through connection 153 places the conducting layer 151 in electrical contact with a wiper fitting 155. Wiper fitting 155 has an angled wiper portion 157 which is in contact with a conducting layer 161 on the inside of first telescoping section 117. Likewise, the lower portion of first telescoping section 117 includes a conducting layer 161 which is inwardly exposed. Conducting layer 161 has a lower electrical through connection 163 which places the conducting layer 161 in electrical contact with a wiper fitting 165. Similarly, wiper fitting 165 has an angled wiper portion 167 which is in contact with a conducting layer 171 on the inside of left projection 107.

While the present invention has been described in terms of a multiple swivel flashlight, and especially having an angled support which permits 360° pivoting rotation of reflectors to give easy and rapid divergence and convergence of the light beams, as well as a telescoping capability for vertical height adjustment and user determined height and spacing of the reflectors, the present invention may be applied in any situation where the ease and utility of the combined structures are desired to increase the utility of use of portable lighting.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A portable flashlight comprising:

a main housing;

a source of power having at least a first and a second pole and located within said main housing;

a first conducting reflector support arm electrically connected to said first pole of said source of power;

a second conducting reflector support arm electrically connected to said second pole of said source of power;

a first reflector light source supported by and pivotally rotatable with respect to said first and said second conducting reflector support arms and electrically connected in series between said first and said second conducting reflector support arms;

a second reflector light source supported by and pivotally rotatable with respect to said first and said second conducting reflector support arms and electrically connected in series between said first and said second conducting reflector support arms.

2. The portable flashlight as recited in claim 1 and wherein said first and second conducting reflector support arms are angled with respect to said main housing.

3. The portable flashlight as recited in claim 1 and wherein said main housing is elongate having a flat bottom and a battery end cap opposite said first and said second conducting reflector support arms.

4. The portable flashlight as recited in claim 1 and wherein said main housing includes at least one of a charging and auxiliary power port for enabling said portable flashlight to accept energy external to said main housing.

5. The portable flashlight as recited in claim 1 and wherein said first and second conducting reflector support arms each include a conductive circular area annular portion for facilitating electrical power transfer to said first and said second reflector light sources throughout a full range of pivot of each of said first and second conducting reflector support arms.

6. The portable flashlight as recited in claim 1 and wherein said a first and said second conducting reflector support arms are telescoping and wherein one of said first and second reflector light sources are displaceable away from the other of said first and second reflectors.

* * * * *